US010172483B2

(12) United States Patent
Chen et al.

(10) Patent No.: US 10,172,483 B2
(45) Date of Patent: Jan. 8, 2019

(54) RACK SYSTEM HAVING ELECTRICAL SUPPLY

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Dong Chen, Zhejiang (CN); Kai Xu, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 15/628,081

(22) Filed: Jun. 20, 2017

(65) Prior Publication Data

US 2018/0332979 A1 Nov. 22, 2018

(51) Int. Cl.
*A47F 5/00* (2006.01)
*A47F 11/10* (2006.01)

(52) U.S. Cl.
CPC ..... *A47F 5/0043* (2013.01); *A47F 5/0081* (2013.01); *A47F 11/10* (2013.01)

(58) Field of Classification Search
CPC ..... A47F 5/0043; A47F 11/10; A47F 5/0081
USPC ..... 174/99 B
See application file for complete search history.

(56) References Cited

U.S. PATENT DOCUMENTS 5,690,415 A * 11/1997 Krehl ..... A47F 5/101 108/23
9,420,901 B2 * 8/2016 Sun ..... A47F 5/0043
9,717,348 B2 * 8/2017 Gosling ..... A47F 5/0043
9,936,826 B2 * 4/2018 Agnoli ..... A47F 10/00

* cited by examiner

*Primary Examiner* — Dhiru R Patel
(74) *Attorney, Agent, or Firm* — Wang Law Firm, Inc.

(57) ABSTRACT

A rack system having an electrical supply includes at least one backboard, a bus bar mounted on one of the backboard, and at least one supplier arranged on the bus bar. The bus bar includes a track body, two magnetic strips provided on the track body, and two current conductors spaced apart and disposed on the track body. The magnetic strip receiving grooves and the conductor receiving grooves being arranged two side walls of the track body respectively in a cross section perpendicular to the extending direction of the track body. The supplier includes two resilient contactors spaced apart from each other, and two magnetic columns arranged both sides of the resilient contactors respectively. When the supplier is mounted on the bus bar, the two resilient contactors are electrically connected to the current conductor.

14 Claims, 4 Drawing Sheets

RACK SYSTEM HAVING ELECTRICAL SUPPLY

RELATED APPLICATION

This present application claims benefit of the Chinese Application, CN201710345195.7, filed on May 16, 2017.

BACKGROUND

1. Technical Field

The present application relates to a shelving equipments, and more particularly to a rack system having an electrical supply.

2. Description of the Related Art

The rack system is widely used, such as in shopping malls, logistics warehouses, factory warehouses, and so on, and is provided to place some goods or display some items. The lighting is necessary in the rack system, especially in the use of the shelve in the store, the lighting requirements are particularly high, such as saving space, security, easy assembly, beauty, and so on.

In the prior art, the wires of the electrical supply of the rack system generally first passes through the hollow shelve rail of the rack system, and extends out from the shelve rail, and then, it are arranged along carrier elements to supply electric for the lighting. However, when the entire rack system has been assembled and placed in the mall or supermarket, if you want to set the electrical supply, it will be very troublesome as it is difficult to disassemble the entire shelf and need to arrange the wires. As a result, it costs plurality of manpower hours.

Therefore, it is necessary to provide a rack system having an electrical supply which makes it possible to solve the above problem.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout two views.

DETAILED DESCRIPTION

The present application is illustrated by way of example and not by way of limitation in the figures of the accompanying drawings. It should be noted that references to "an" or "one" embodiment in this application are not necessarily to the same embodiment, and such references mean at least one.

Figure 1:
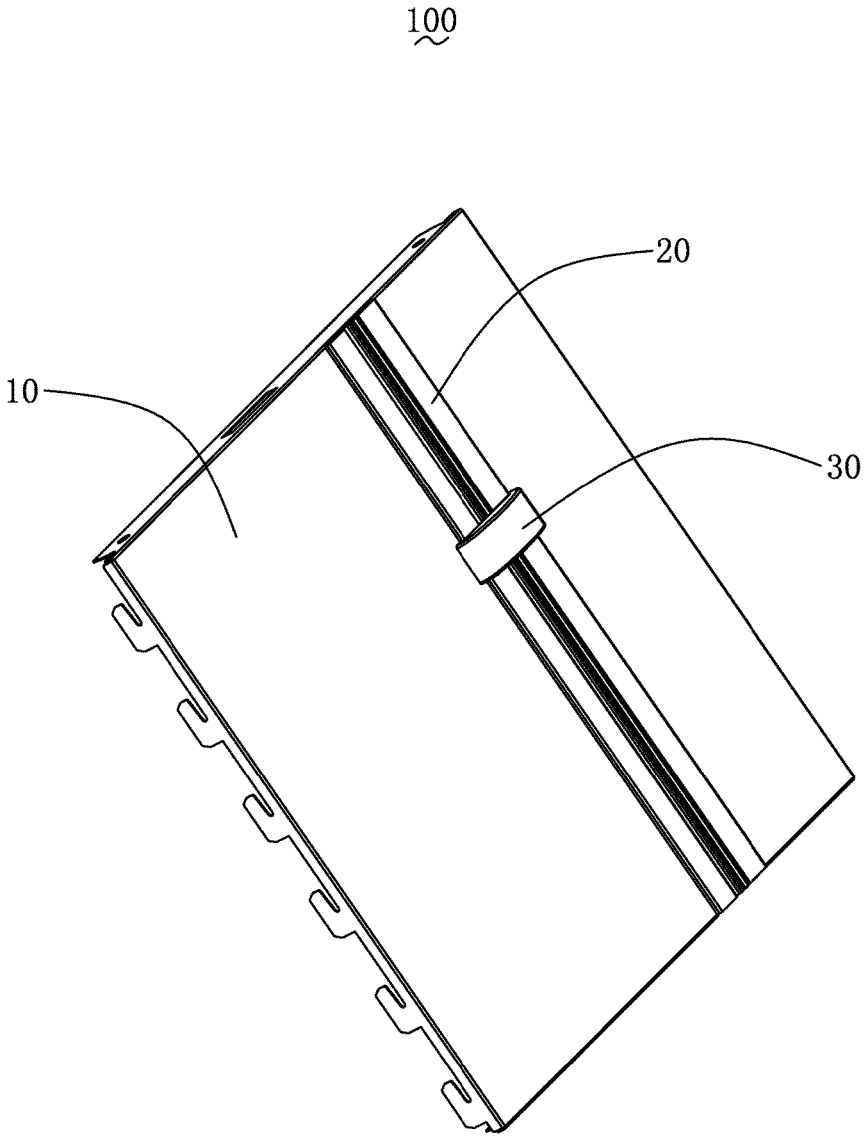
FIG. 1 is an isometric view of a rack system having an electrical supply according to an embodiment.
Figure 2:
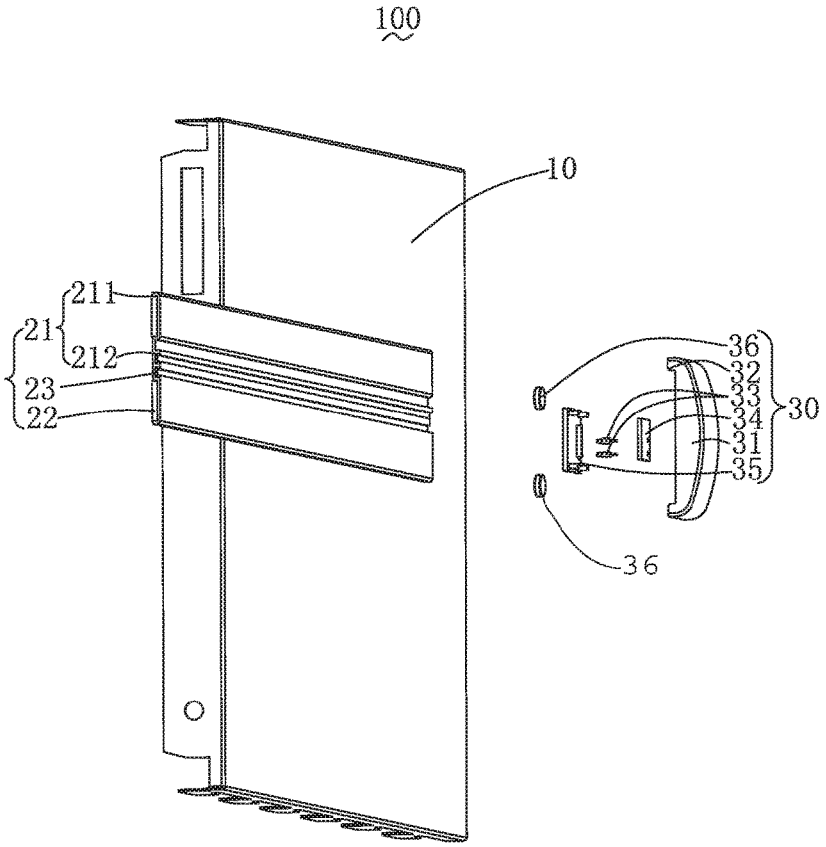
FIG. 2 is an explored view of the rack system having the electrical supply of FIG. 1.
Figure 3:
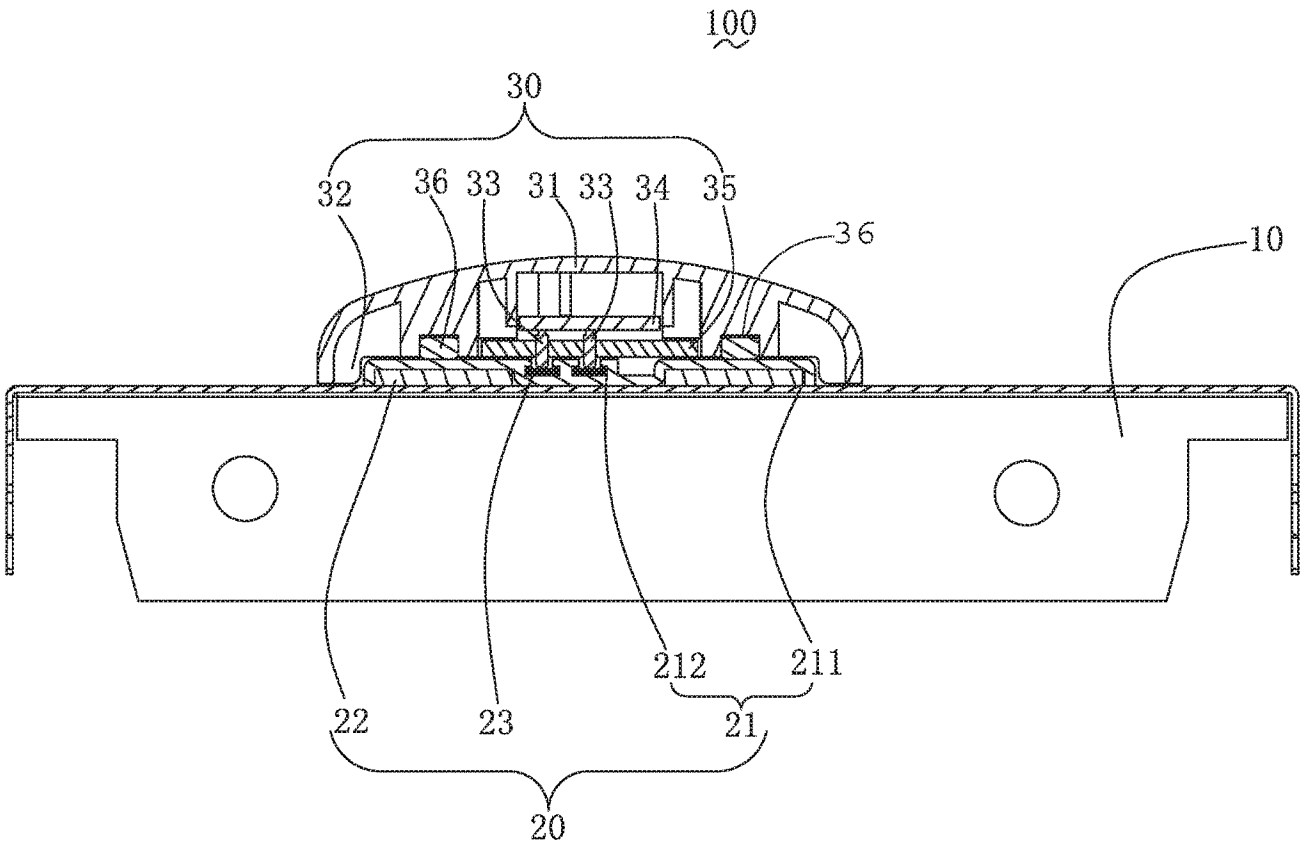
FIG. 3 is a cross sectional view of the rack system having the electrical supply FIG. 1.
Figure 4:
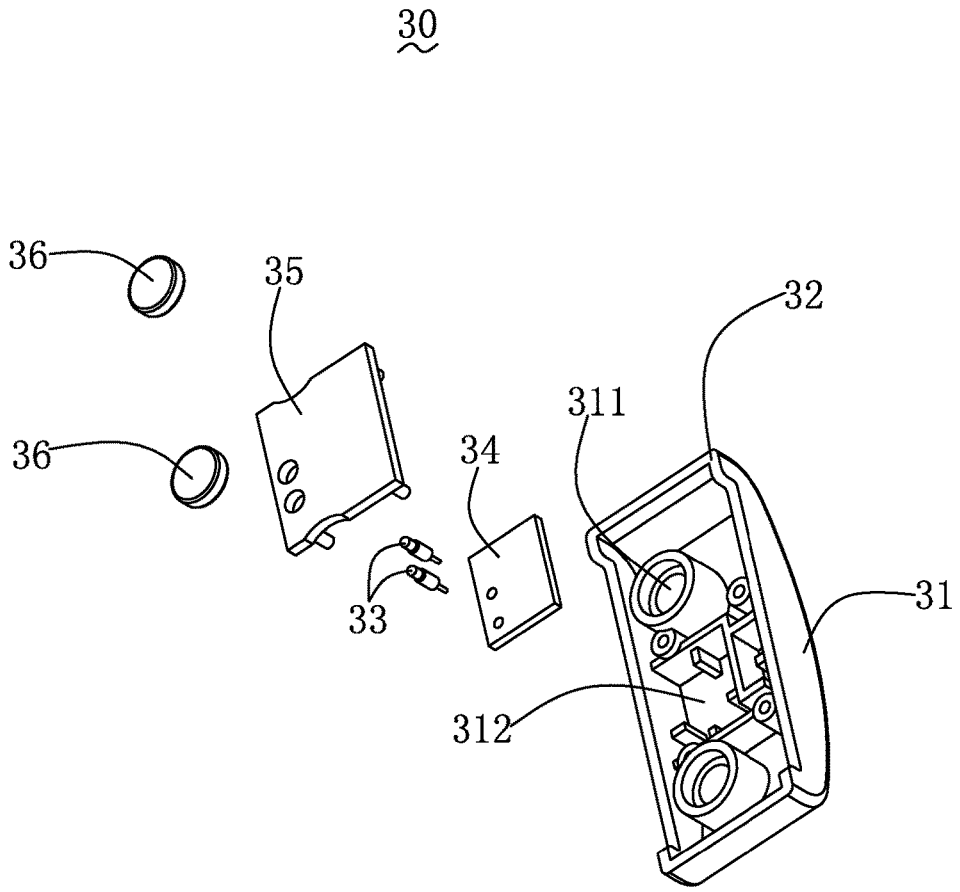
FIG. 4 is an explored view of a supplier of the rack system having the electrical supply of FIG. 1.

Referring to FIG. 1 to FIG. 4, a rack system having an electrical supply 100 is shown. The rack system having the electrical supply 100 includes at least one backboard 10, a bus bar 20 mounted on the backboard 10, and at least one supplier 30 arranged on the bus bar 20. As is well known, the rack system having the electrical supply 100 may include other modules, such as shelves rails, carrier elements, angle brackets, and so on, and wires electrically connecting the bus bar 20 with main powers, and wires electrically connecting the supplier 30 to the lightings. These modules are well known by a person skilled in the art, and no need to explain in detail.

The backboard 10 may be typically a flat plate and made of metal material, such as steel, and is inserted into the shelves rails for isolating different shelf spaces. The backboard 10 has a same configuration with that in the existing supermarket or the shopping mall. Therefore, it is no need to describe in detail.

The bus bar 20 includes a track body 21, two magnetic strips 22 provided on the track body 21, and two current conductors 23 spaced apart from each other and disposed on the trace body 21. In order to prevent electric leakage, the track body 21 is made of insulating material, such as plastic. The track body 21 may be arranged along the vertical direction of the shelves rails so that the lamps provided on a plurality of the carrier elements can be powered. In a cross section perpendicular to the extending direction of the track body 21, the track body 21 includes two magnetic strip receiving grooves 211 spaced apart from each other, and two conductor receiving grooves 212 spaced apart from each other and disposed between the two magnetic strip receiving grooves 211. A width and a depth of the magnetic strip receiving grooves 211 are equal to a width and a thickness of the magnetic strip 22. Each of the two conductor receiving grooves 212 includes two L-shaped side walls so that one of the two current conductors 23 can be inserted into the two L-shaded side walls therebetween. The magnetic strips 22 may be made of soft magnetic material so as to be suitably deformed during installation. The magnetic strips 22 are attached to the magnetic strip receiving groove 211 via a method of adhering by glue, and so on. The bus bar 20 can be directly attracted onto the backboard 10 by the magnetic strips 22, and so, the installation of the bus bar 20 can be completed. The two current conductors 23 are inserted in the two conductor receiving grooves 212 respectively and are engaged with the current conductors 23 by the L-shaped side walls of the conductor receiving grooves 212 so as to fix the current conductors 23 therein. In order to make the thickness of the bus bar 20 become thinner, the center lines of the magnetic strips 22 overlap that of the current conductors 23 along the arrangement direction thereof so as to reduce the whole thickness of the bus bar 20. The magnetic strip receiving grooves 211 and the conductor receiving grooves 212 are arranged on two opposite side walls of the track body 21, respectively The supplier 30 includes a main body 31, two holding portions 32 extending from the main body 31, two resilient contactors 33 disposed in the main body 31 and spaced apart from each other, a circuit board 34 mounted in the main body 31, a cover 35 arranged on the circuit board 34, two magnetic columns 36 disposed in the main body 31 and arranged on both sides of the two resilient contactors 33. The main body 31 is provided with two blind holes 311 for receiving the two magnetic columns 36 respectively and a receiving chamber 312 disposed between the two blind holes 311. The main body 31 may be injected from a plastic material and is integrally formed with the blind holes 311 and the receiving chamber 312. The receiving chamber 312 is configured for disposing the circuit board 34 and the two resilient contactors 33. The two holding portions 32 may also be molded together with the main body 31 and extend towards the bus bar 30 and engage with the two side walls of the bus bar 20 which are perpendicular to the arrangement direction of the magnetic strips 22 and the current conductors 23. Therefore, the supplier 30 can be moved along the extending direction of the bus bar 20. The resilient contactors 33 are prior art known to those skilled in the art and will be briefly described herein. The resilient contactor 33 includes a sleeve, a spring disposed in the sleeve, and a circular or stepped contactor extending beyond one end of the sleeve. The contactor can be secured in the sleeve by compressing the sleeve port to form the resilient contactor 33. The circuit board 34 is prior art known to those skilled in the art and is configured for electrically connecting various electronic components, such as triodes, diodes, resistors, and the like. The resilient contactors 33 may be fixed onto the circuit board 34 and electrically connected to the outer wires. The method of fixing the resilient contactors 33 may be a soldering. The cover 35 is arranged onto the circuit board 34 to protect the circuit board 34. It will be appreciated that the cover 35 is provided with two through holes therein for the resilient contactors 33. The magnetic columns 36 may be fixed in the two blind holes 311 respectively by interference fit.

In use, the bus bar 20 is firstly attached to the appropriated position of the backboard 10 by the magnetic strips 22, and the supplier 30 is arranged onto the bus bar 20. The two magnetic columns 36 are attached onto the two magnetic strips 22 respectively, and the two resilient contactors 33 are respectively abutted against the two magnetic strips 22 when the supplier 30 is mounted on the bus bar 20 so that the two resilient contactors 33 are electrically connected to the current conductors 33, respectively. In addition, when the resilient contactors 33 are electrically connected to the current conductors 23, the resilient contactor 33 will pass through the gap formed between the two L-shaped side walls of the conductor receiving grooves 212.

Compared with the prior art, the rack system having the electrical supply 100 provided by the present invention can make the bus bar 20 thinner by using the structure thereof, for example, a thickness of 2 mm to 3 mm. Therefore, the bus bar 20 can directly pass from the tolerance gap between the backboard 10 and the carrier elements without disassembling the whole rack system, thereby completing the installation of the bus bar 20. And then, the supplier 30 can be directly placed onto the bus bar 20 so as to achieve electrically connection. As a result, it is easy to install the rack system having the electrical supply so as to save cost and time.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A rack system having an electrical supply, comprising:
at least one backboard;
a track body with a plurality of grooves attached to the backboard;
two magnetic strips disposed on two grooves on the track body;
two current conductors disposed in two separate grooves between the two magnetic strips; and
a supplier attached on top of the track body, the supplier comprising
two contactors spaced apart from each other, and
two magnetic columns arranged both sides of the contactors and attached onto the two magnetic strips,
wherein each contactor abuts against one of the magnetic strips so that the two contactors are electrically connected to the current conductor.

2. The rack system having the electrical supply as claimed in claim 1, wherein the track body is made of insulation material.

3. The rack system having the electrical supply as claimed in claim 1, wherein the supplier further comprises a main body, and two holding portions extending from the main body, the two holding portions are engaged with two side walls of the track body which are perpendicular to a longitudinal direction of the magnetic strips and the current conductors.

4. The rack system having the electrical supply as claimed in claim 3, wherein the main body comprises two blind holes, each blind hole receives a magnetic column, and a receiving chamber disposed between the two blind holes, the receiving chamber is configured to receive the contactors.

5. The rack system having the electrical supply as claimed in claim 4, wherein the supply further comprises a circuit board disposed inside the receiving chamber, and a cover covers the circuit board disposed inside the receiving chamber, the contactor is welded to the circuit board and protrudes out of the cover.

6. The rack system having the electrical supply as claimed in claim 1, wherein the two magnetic strips are made of soft magnetic material.

7. The rack system having the electrical supply as claimed in claim 1, wherein the backboard is made of metal material, the track body is directly attached onto the backboard through the two magnetic strips.

8. The rack system having the electrical supply as claimed in claim 1, wherein the two grooves receiving the two conductors have an L-shaped cross section.

9. The rack system having the electrical supply as claimed in claim 8, wherein each contactor passes through a gap in the L-shaped cross section and electrically connects to the current conductor.

10. The rack system having the electrical supply as claimed in claim 1, wherein the center line of the magnetic strip is overlapped with that of the current conductor along the arrangement direction of the magnetic strip and the current conductor.

11. A rack system comprising:
a backboard;
a bus bar mounted on the backboard, the bus bar having a plurality of conductors and a plurality of magnetic strips; and
a supplier attached to the bus bar, the supplier having a receiving chamber, a cover removably attached to the receiving chamber, and an electric circuit with a plurality of holes placed inside the receiving chamber; and
a plurality of resilient contactors electrically attached to the electric circuit through the plurality of holes and connecting the electric circuit to the plurality of conductors, and a plurality of magnetic columns,
wherein the bus bar is mounted to the backboard through the plurality of magnetic strips and the supplier is attached to the bus bar through the plurality of magnetic columns.

12. The rack system of claim 11, wherein the bus bar further comprises a track body, the track body has a first plurality of grooves for receiving the plurality of conductors and a second plurality of grooves for receiving the plurality of magnetic strips, the first plurality of grooves and the second plurality of grooves face opposite sides.

13. The rack system of claim 12, wherein the first plurality of grooves have a L-shape cross section.

14. The rack system of claim 11, wherein the supplier further comprises a plurality of blind holes, the plurality of blind holes receive the plurality of magnetic columns.

* * * * *